US006589602B2

(12) United States Patent
Kobayashi et al.

(10) Patent No.: US 6,589,602 B2
(45) Date of Patent: Jul. 8, 2003

(54) HIGHLY ADHESIVE SURFACE-COATED CEMENTED CARBIDE AND METHOD FOR PRODUCING THE SAME

(75) Inventors: Masaki Kobayashi, Kanagawa (JP); Hiroshi Kitada, Kanagawa (JP)

(73) Assignee: Toshiba Tungaloy Co., Ltd., Kawasaki (JP)

( * ) Notice: Subject to any disclaimer, the term of this patent is extended or adjusted under 35 U.S.C. 154(b) by 14 days.

(21) Appl. No.: 09/835,589

(22) Filed: Apr. 17, 2001

(65) Prior Publication Data

US 2003/0026966 A1 Feb. 6, 2003

(51) Int. Cl.[7] ..... B05D 1/36; B05D 3/00; B05D 7/00; C23C 16/00

(52) U.S. Cl. ..... 427/404; 427/419.7; 427/419.1; 427/248.1; 427/255.28; 205/219; 205/238; 205/261

(58) Field of Search ..... 427/404, 419.1, 427/419.7, 248.1, 255.28; 205/205, 219, 238, 261

(56) References Cited

U.S. PATENT DOCUMENTS

| | | | | | |
|---|---|---|---|---|---|
| 3,640,689 | A | * | 2/1972 | Glaski et al. | 427/249.18 |
| 5,451,469 | A | * | 9/1995 | Gustafson et al. | 428/547 |
| 5,650,059 | A | * | 7/1997 | Shumaker et al. | 205/640 |
| 5,981,091 | A | * | 11/1999 | Rickerby et al. | 428/548 |

FOREIGN PATENT DOCUMENTS

| | | |
|---|---|---|
| DE | 237 764 | 7/1986 |
| GB | 2 061 324 | 5/1981 |
| JP | 48-32734 | 5/1973 |
| JP | 59-107060 | 6/1984 |
| JP | 4-87706 | 3/1992 |
| JP | 4-183877 | 6/1992 |
| JP | 5-123903 | 5/1993 |
| JP | 5-263252 | 10/1993 |
| JP | 6-108253 | 4/1994 |
| JP | 7-97603 | 4/1995 |
| JP | 7-243023 | 9/1995 |
| JP | 8-118105 | 5/1996 |
| JP | 8-187605 | 7/1996 |
| JP | 9-262705 | 10/1997 |

* cited by examiner

*Primary Examiner*—Michael Barr
(74) *Attorney, Agent, or Firm*—Foley & Lardner

(57) ABSTRACT

The present invention is to provide a highly adhesive surface-coated cemented carbide which comprises a cemented carbide base material and a hard film formed on a surface of the base material, characterized in that both of the hard film at a proximate portion of an interface between the hard film and the cemented carbide base material and the cemented carbide at a proximate portion of an interface contain at least one diffusive element selected from chromium, molybdenum, manganese, copper, silicon and an iron group metal and a method for producing the same by uniformly coating at least part of a surface of the base material with a metal, an alloy, or a compound comprising at least one diffusive element selected from iron group metals, chromium, molybdenum, manganese, copper, and silicon followed by coating the surface with the hard film.

18 Claims, No Drawings

HIGHLY ADHESIVE SURFACE-COATED CEMENTED CARBIDE AND METHOD FOR PRODUCING THE SAME

BACKGROUND OF THE INVENTION

1. Field of the Invention

The present invention relates to a surface-coated cemented carbide usable for cutting tools represented by a tip, a drill and an end mill and various wear-resistant tools and parts. Particularly, the present invention relates to a surface-coated cemented carbide which has a prolonged tool life by improving an adhesiveness at an interface between a hard film and a cemented carbide base material by having both of a cemented carbide base material and a hard film, at a proximate portion of the interface, contain at least one diffusive element selected from an iron group metal, chromium, molybdenum, manganese, copper and silicon. The present invention further relates to a method for producing the surface-coated cemented carbide comprising a step of uniformly coating a surface of the cemented carbide base material with the diffusive element in advance and a successive step of coating the surface with the hard film.

2. Prior Art

Surface-coated cemented carbides wherein cemented carbide base material is coated with a hard film of TiC, TiCN, TiN or $Al_2O_3$ by a chemical vapor deposition or physical vapor deposition method exhibit strength and toughness of the base material as well as wear resistance of the hard film. Therefore, they are widely used as cutting tools and wear-resistant tools or parts. However, when the adhesiveness between the base material and the hard film is not satisfactory, the cemented carbides are rapidly worn down due to exfoliation of the film upon use, thereby shortening a tool life.

Since the adhesiveness of the film is largely affected by a diffusion state of cemented carbide components such as cobalt and tungsten in the hard film, many attempts have been made such as adjustment of the base material surface, the selection of the film materials for an undercoat layer, the optimization of coating conditions of the undercoat layer and the like. In Japanese Patent Laid-Open Publications No. 243023/1995, No. 118105/1996, No. 187605/1996, No. 262705/1997, No. 263252/1993, and so forth, there are disclosed that the base material components such as cobalt and tungsten are diffused into the hard film.

On the other hand, the base material of a surface-coated cemented carbide is formed into a shape depending on the usage, by grinding or the like. Therefore, it is consisted of the mechanically processed surface and an as-sintered surface which is not ground. At the mechanically processed surface, processing swarf containing cobalt is attached relatively uniformly to the uppermost surface, but there is a problem that there remain a degenerated layer due to processing (cracks in the hard phase particles, defect at an interface between the hard phase particles or between the hard phase particle and the binder phase, the transformation of the binder phase) near the surface. Furthermore, in the as-sintered surface, although there exists no degenerated layer, there is a problem that the binder phase is not present on the hard phase particles due to a sever surface irregularity.

Accordingly, as a means for providing suitable amount of cobalt uniformly dispersed at the cemented carbide surface and removing the degenerated layer at the mechanically processed surface, and smoothening the surface and enriching cobalt at the as-sintered surface, methods of controlling the processing conditions or re-sintering methods are proposed. Among the prior art methods, a method for reducing surface roughness is disclosed in Japanese Patent Laid-Open Publication No. 108253/1994, etc., and a re-sintering method is disclosed in Japanese Patent Laid-Open Publications No. 123903/1993, No. 097603/1995, etc.

With regard to diffusion of the base material components into the hard film, Japanese Patent Laid-Open Publications No. 243023/1995, No. 118105/1996, No. 187605/1996 and No. 262705/1997 disclose a cutting tool made of a surface coated tungsten carbide (WC)-based cemented carbide wherein a hard coating layer is formed on a surface of a WC-based cemented carbide substrate by CVD method, the layer comprising a basic film structure composed of the first layer of TiC or TiN, the second layer of TiCN with a growing columnar crystalline structure, the third layer of TiC, TiCO, etc. and the fourth layer of $Al_2O_3$ containing κ-type crystals, at least tungsten and cobalt among the cemented carbide components being diffused and dispersed in the first and second layers or the first to third layers. The coated cemented carbides disclosed in these publications exhibited improved adhesiveness due to diffusion of tungsten and cobalt into the hard film. However, there is a problem that the adhesiveness is not improved sufficiently by merely controlling the coating conditions such as a type of film, temperature, gas partial pressure, and the like.

Japanese Patent Laid-Open Publication No. 263252/1993 discloses a coated cemented carbide member which comprises the first coating layer comprising TiC, the second coating layer comprising TiCN having a lattice constant of 4.251 to 4.032 angstroms, and the third coating layer comprising TiC on the surface of a cemented carbide base material. The coated cemented carbide member disclosed in the publication has been improved simultaneously in wear resistance and chipping resistance as a cutting tool by preventing diffusion of tungsten, etc. and absorption of cobalt from cemented carbide base material during a coating layer formation. That is, TiC in the first coating layer and WC in the cemented carbide base material are relatively excellent in adhesiveness, and by increasing the amounts of C and N in TiCN of the second coating layer, it is intended to prevent the diffusion of C from the base material. However, there is a problem that a brittle Co—W—C type composite carbide tends to form at the interface, and improvement in adhesiveness is limited since there is no highly adhesive diffusion layer formed resulting from diffusion of cobalt and tungsten.

On the other hand, among the prior arts, as a method for reducing surface roughness, Japanese Patent Laid-Open Publication No. 108253/1994 discloses a coated cemented carbide wherein a hard film is coated on a surface of the cemented carbide having an average surface roughness Ra of 0.15 to 0.4 $\mu$m, on which scratches are formed by polishing in random directions by, for example, brushing the cemented carbide surface. The cemented carbide disclosed in the publication exhibits improved adhesiveness of the hard film to the base material by attaching cobalt uniformly on the hard particles of the cemented carbide surface through the attachment of grinding swarf caused by brushing, but the amount of cobalt is not sufficient and formation of a degenerated layer is accompanied, so that there exists a problem that improvement of the adhesiveness is not sufficient.

Moreover, as re-sintering method, Japanese Patent Laid-Open Publication No. 123903/1993 discloses a method for manufacturing a cutting tool member made of a surface-coated WC-based cemented carbide wherein a hard coating layer is formed by chemical vapor deposition using, as a substrate, a cemented carbide that has been re-sintered at a higher temperature than liquid phase-appearing temperature in a high pressure inert gas atmosphere after grinding the surface. Japanese Patent Laid-Open Publication No. 097603/1995 discloses a method for producing a ceramics based substrate for diamond coating and a substrate for coating wherein the cutting edge of a cemented carbide tip is subjected to arc honing of R=0.03 mm and then re-sintered in a 1% $N_2$—Ar atmosphere to form a concavo-convex layer containing nitrogen at the surface. The re-sintered surfaces disclosed in these publications exhibit slight improvement in adhesiveness owing to the complete removal of the degenerated layer, but there is a problem that improvement of the adhesiveness is insufficient since cobalt attached on the surfaces of the hard phase particles by grinding disappears during re-sintering and therefore, no diffusion layer is formed. Furthermore, there also exists a problem that a processed material tends to adhere at the re-sintered surface owing to the increase of the concavo-convex surface and therefore, exfoliation of the film or the lowering of accuracy of the finished face is resulted in.

SUMMARY OF THE INVENTION

Accordingly, an object of the present invention is to provide a surface-coated cemented carbide that has an improved adhesiveness at an interface between the hard coating film and the cemented carbide base material therefore attaining an improved wear resistance of a resultant cutting tool.

The present inventors have made extensive and intensive studies in search for a method for drastically improving adhesiveness between the base material and the film with respect to the surface-coated cemented carbide for a long period of time and have finally found that diffusion and dispersion of specific compositional element in both of the hard film and the cemented carbide base material largely enhance the adhesiveness due to an effect of accelerating diffusion of the specific element or an effect of enhancing the interface strength, that the most suitable element is at least one selected from iron group metals, chromium, molybdenum, manganese, copper and silicon, and that, in order to diffuse the specific element into the cemented carbide base material and the hard film, it is effective to disperse or coat a metal, an alloy or a compound of the specific element on the surface of the cemented carbide base material before coating a hard film. Based on those findings, the present invention has been accomplished.

Namely, the present invention relates to a highly adhesive surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 (IVa, Va and VIa) of the Periodic Table and a mutual solid solution thereof and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a mutual solid solution thereof, characterized in that both of the hard film at a proximate portion of an interface between the hard film and the cemented carbide base material and the cemented carbide at a proximate portion of the interface contain the binder phase component, tungsten and at least one diffusive element selected from chromium, molybdenum, manganese, copper, silicon and an iron group metal other than the main component of the binder phase.

Further, the present invention relates to a method for producing a highly adhesive surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a mutual solid solution thereof and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a mutual solid solution thereof, characterized in that the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component.

DESCRIPTION OF PREFERRED EMBODIMENTS

As a base material of the surface-coated cemented carbide of the present invention, it comprises hard phase particles comprising tungsten carbide as a main component and at least one material selected from the group consisting of a carbide, a nitride and a carbonitride of a metal selected from metals of the Groups 4 (Ti, Zr, Hf, etc.), 5 (V, Nb, Ta, etc.) and 6 (Cr, Mo, W, etc.) of the Periodic Table and a mutual solid solution thereof as an auxiliary component, and a binder phase comprising an iron group metal (Fe, Co, Ni, etc.) as a main component. Specific examples of the cemented carbide include alloys in which hard phase particles comprise only tungsten carbide, such as WC—Co type or WC—(Ni—Cr) type alloy and alloys in which hard phase particles comprises tungsten carbide and cubic crystalline compounds, such as WC—TaC—Co type, WC—(W, Ti, Ta)C—Co type, WC—(W, Ti, Ta)C—(Co, Ni, Cr) type, or WC—(W, Ti, Ta, Nb)(C, N)—Co type alloy, with a relative amount of the binder phase being from about 3 to 30% by volume.

As a constitution of a hard film, the film comprises at least one layer which may be a single layer or a laminated layers of two or more layers. As a component for constituting the hard film, there may be mentioned at least one material selected from a carbide, a nitride and an oxide of an element selected from elements of the Groups 4 (Ti, Zr, Hf, etc.), 5 (V, Nb, Ta, etc.) and 6 (Cr, Mo, W, etc.) of the Periodic Table, aluminum and silicon and a mutual solid solution thereof. Specific examples of the hard film may include a single layer film comprising at least one of TiC, TiCN, (Ti,Zr)N, (Ti,Al)N, CrN or the like, and laminated layers such as, from the base material side, TiC/TiN/TiCN/TiN, TiN/TiC/$Al_2O_3$, TiN/TiCN/TiC/$Al_2O_3$/TiN, TiN/(Ti,Al)N/TiN, TiN/$Si_3N_4$, CrN/VN or the like, having a thickness in total of 1 to 20 $\mu$m prepared by a chemical vapor deposition or physical vapor deposition method. In the case of the laminated layers, it is preferred that the undercoat layer (near the interface with the cemented carbide base material) preferably comprises at least one substance selected from a nitride, a carbide or a carbonitride of titanium because the diffusive element can be easily diffused into the film, thereby adhesiveness can be further improved.

With regard to a content of the diffusive elements in the highly adhesive surface-coated cemented carbide of the present invention, specifically, at least 0.5 atomic % of the diffusive elements is contained in the hard film and the cemented carbide base material within the range of 0.5 $\mu$m from the interface between the hard film and the cemented carbide base material to both of the hard film and the cemented carbide base material, based on the micro-analysis at a section of the surface-coated cemented carbide. It is preferably in the range of 1 to 10 atomic %. Needless to say, tungsten diffused from the cemented carbide base material is also contained in the hard film.

Furthermore, in the case that a diffusive element is added to the binder phase component of the cemented carbide base material, specifically, the content of the diffusive element in the cemented carbide base material within 0.5 μm from the interface is at least 0.5 atomic % higher than a content at 100 μm inside from the interface.

In addition, when the content of the diffusive element is at the maximum at the interface between the hard film and the cemented carbide and gradually decreases from the interface toward inside of the hard film and the cemented carbide, the composition structure becomes a gradient and thus is preferable. Moreover, when the binder phase component and tungsten and the diffusive element are diffused and contained also in the hard film immediately on the hard phase particles at the interface between the hard film and the cemented carbide base material, a uniform diffusion layer having a large amount of diffusion elements can be formed as compared with the conventional case where diffusion occurs in the hard film only immediately on the binder phase.

In the highly adhesive surface-coated cemented carbide of the present invention, it is preferred to prepare a metal layer with an average thickness of 0.5 μm or less comprising a diffusive element as a main component at the interface between the hard film and the cemented carbide base material because the adhesiveness is further improved in some cases. Moreover, with regard to the hard phase, when any hard phase particles of 0.2 μm or less are substantially absent and no crack is present in the hard phase particles at the surface of the cemented carbide adjacent to the interface between the cemented carbide and the cemented carbide base material, i.e., the degenerated layer caused by a mechanical processing is removed from the surface of the base material, it is preferred since adhesiveness at the interface can be further improved.

In the highly adhesive surface-coated cemented carbide of the present invention, when a main component of the binder phase is cobalt and the diffusive element is at least one element selected from nickel, iron, chromium, molybdenum, manganese, copper and silicon, it is preferable since the cemented carbide base material becomes excellent in hardness and toughness and, at the same time, the diffusive element is properly diffused and contained in both of the hard film and the cemented carbide base material, thereby improving adhesiveness.

A method for producing the highly adhesive surface-coated cemented carbide of the present invention is characterized in that the method comprises the steps of (1) uniformly coating at least part of the surface of the above-mentioned cemented carbide base material with a metal, an alloy or a compound comprising at least one diffusive element selected from an iron group metal (Fe, Co, Ni, etc.), chromium, molybdenum, manganese, copper and silicon, and then, (2) coating the hard film component on the surface of the cemented carbide base material.

As a coating method of the diffusive element in the production method of the present invention, specific examples include a chemical coating method such as electroplating, electroless plating, physical vapor deposition (PVD), chemical vapor deposition (CVD), colloid application, or solution application with a metal, an alloy or a compound comprising the diffusive element, and a mechanical coating such as blast processing or shot treatment using a shot material comprising the diffusive element as a main component or using a mixture of the shot material and an abrasive sweeper or an abradant. Particularly, the coating by electroplating or electroless plating with a metal, an alloy or a compound comprising the diffusive element is preferably employed since a coating can be performed at a low cost and the resultant coating is uniform.

Moreover, in the production method of the present invention, it is preferable that at least part of the surface of the cemented carbide base material before coating with the above diffusive element is an as-sintered surface, a ground lap face, an electrolytic ground skin, or a chemically etched face, because an excellent adhesion is effected due to the absence of any remaining degenerated layer. In particular, the skin treated by electrolysis or the chemically etched face are preferably used because the adhesiveness is further improved by removal of the degenerated layer at the ground face and by a smooth surface obtained at the as-sintered surface face.

Furthermore, in the production method of the present invention, it is preferred that the surface of the cemented carbide base material is subjected to electropolishing using an aqueous solution containing at least one substance, as an essential component, selected from a hydroxide, a nitrite, a sulfite, a phosphite, a carbonate of a metal of metals selected from the Group 1 (Ia) of the Periodic Table, under the conditions of a current density of 0.01 to 0.2 $A/cm^2$, followed by electroplating using an aqueous solution containing an diffusive element and/or a binder phase component, since the adhesiveness is remarkably improved as well as the process is simple and convenient and also inexpensive. As the reasons for the improved adhesiveness, there may be mentioned, specifically, the complete removal of the degenerated layer (hard phase particles with a particle diameter of more than 0.2 μm and having cracks therein) on the surface of the cemented carbide base material, the ability to selectively orient tungsten carbide particles of the base material surface into a specific crystal plane (WC(001) face) coordinated with the undercoat layer of the hard film, and the like.

In the highly adhesive surface-coated cemented carbide of the present invention, at least one element selected from an iron group metal, chromium, molybdenum, manganese, copper and silicon is diffused and migrated in both of the hard film and the cemented carbide near the interface between the hard film and the cemented carbide so that it has an effect of improving the adhesiveness between the film and the base material. In the method for producing the same, a metal, an alloy, or a compound comprising at least one element selected from an iron group metal, chromium, molybdenum, manganese, copper and silicon is uniformly coated on the surface of the base material before coating the hard film-forming material so that these elements are diffused and migrated in both of the hard film and the cemented carbide near the interface whereby the adhesiveness between the film and the base material can be more improved.

EXAMPLES

Hereinbelow, the present invention will be described in more detail with reference to the following Examples, which should not be construed as limiting the scope of the present invention.

Example 1

Using a tip material with breaker of CNMG120408 at ISO Standards comprising a composition of 86.0WC-1.5TiC-0.5TiN-4.0TaC-8.0Co (wt %), the boss surface was ground with #270 diamond whetstone and the edge part was subjected to honing at a radius of 0.04 mm with a polyamide brush containing #320 silicon carbide honing grains to obtain a base material tip for a coated cemented carbide.

Then, the tip was subjected to a surface treatment according to the methods and conditions shown in Table 1, respectively, followed by ultrasonic washing in acetone. Then, it was coated with, from the base material side, 1.0 μm of TiN, 8.0 μm of columnar crystalline TiCN, 1.5 μm of $Al_2O_3$ and 0.5 μm TiN, with a thickness of 11.0 μm in total, using a CVD coating apparatus to obtain tool tips of surface-coated cemented carbides of the present invention 1 to 8 and the comparative product 1 to 5.

TABLE 1

| Sample No. | Name of Surface Treatment | Treating Conditions etc. |
|---|---|---|
| Present products | | |
| 1 | electroplating | treated in 10% $NiSO_4$ solution at 0.5A × 0.5 min. |
| 2 | electroplating | treated in 10% $NiSO_4$ + 2% $CuSO_4$ solution at 0.5A × 0.5 min. |
| 3 | electropolishing and electroplating | treated in 10% $NaNO_2$ solution at 0.5A × 0.5 min., then plated same as in the Present product 1 |
| 4 | electropolishing and electroless plating | treated as above, then treated with commercial electroless plating Ni solution for 0.5 min. |
| 5 | vacuum deposition | treated with a Ni-30% Cr plate by heating and vaporizing it in vacuum for 1 min. |
| 6 | brush grinding and vacuum deposition | treated under the same conditions as in Comparative product 3, then with Fe-50% Mo plate for 1 min. |
| 7 | Mn bombard | treated in arc plasma discharge targeting to Mn plate at −200 V × 10 min. |
| 8 | blasting | subjected to dry blasting with #800 Ni metal powder for 15 sec. |
| Comparative products | | |
| 1 | no treatment | — |
| 2 | electropolishing | treated in 10% $NaNO_2$ solution at 0.5A × 0.5 min. |
| 3 | brush grinding | grinding over whole surface with polyamide brush containing #600 SiC grinding grains |
| 4 | re-sintering | kept in vacuum of about 100 Pa at 1400° C.-10 min. |
| 5 | blasting | subjected to dry blasting with #800 alumina abrasive sweeper for 15 sec. |

A sample for measuring on a field-emission type scanning electron microscope was prepared by cutting each one of the above-obtained tool tips near its corner and then subjecting to lap grinding with diamond paste of 0.5 μm. The edge part of each sample (before brushing) was subjected to a line analysis from the film surface to the inside of the base material using an X-ray microanalyzer and a point analysis at about 0.3 μm inside of the both of the film and the base material from the interface between the film and the base material. Table 2 shows the results of the line analysis, that is, the kinds and distributions of the diffusive elements (elements other than the components of the film and base material) and the results of the point analysis, that is, the amount of the diffusive elements and the content of components of the base material (W, Co, Cr) in the hard film, collected at 10 points.

TABLE 2

| Sample No. | Kind & distribution of diffused element | Amount of diffused element (atomic %) In film | Amount of diffused element (atomic %) In base material | Content of components of base material (atomic %) CO | Content of components of base material (atomic %) W |
|---|---|---|---|---|---|
| Present product | | | | | |
| 1 | containing Ni in hard film and base material with gradient from interface | Ni: 10–16 | 2–5 | 4–8 | 11–18 |
| 2 | containing Ni and Cu in hard film and base material with gradient from interface | Ni: 3–11<br>Cu: 3–6 | 3–5<br>2–5 | 2–7 | 7–12 |
| 3 | containing Ni in hard film and base material with gradient from interface | Ni: 12–17 | 4–6 | 5–8 | 13–19 |
| 4 | containing Ni in hard film and base material with gradient from interface (high content Ni-containing hard film at interface) | Ni: 8–15 | 6–10 | 3–6 | 8–15 |
| 5 | containing Ni and Cr in hard film and base material with gradient from interface | Ni: 6–11<br>Cr: 3–5 | 5–9<br>1–3 | 7–10 | 5–12 |
| 6 | containing Fe and Mo in hard film and base material with gradient from interface (high content Mo-containing hard film at interface) | Fe: 5–8<br>Mo: 1–3 | 4–8<br>3–7 | 3–7 | 8–11 |
| 7 | containing Mn in hard film and base material with gradient from interface | Mn: 1–3 | 2–5 | 5–10 | 7–13 |
| 8 | containing Ni in hard film and base material with gradient from interface | Ni: 2–4 | 1–3 | 8–13 | 9–16 |
| Comparative product | | | | | |
| 1 | no diffusion except for components of hard film and base material | 0 | 0 | 5–8 | 6–10 |
| 2 | no diffusion except for components of hard film and base material | 0 | 0 | 2–5 | 3–8 |
| 3 | no diffusion except for components of hard film and base material | 0 | 0 | 8–11 | 10–15 |
| 4 | no diffusion except for components of hard film and base material | 0 | 0 | 2–9 | 4–8 |
| 5 | no diffusion except for components of hard film and base material | 0 | 0 | 5–9 | 5–10 |

Furthermore, the vicinity of the interface between the hard film and the base material was observed, and Table 3 shows the measuring results of the thickness of the metal layer present at the interface, the cracks in the hard phase (WC) particles, and the fine particles of the hard phase (WC) with a particle diameter of 0.2 μm or less.

TABLE 3

| Sample No. | Thickness of metal phase (μ) | Crack in WC particles | Fine particles of WC |
|---|---|---|---|
| Present product | | | |
| 1 | 0 | present | present |
| 2 | 0 | present | present |
| 3 | 0 | absent | absent |
| 4 | 0.2 | absent | absent |
| 5 | 0 | present | present |
| 6 | 0.4 | present | present |
| 7 | 0 | absent | present |
| 8 | 0 | present | present |
| Comparative product | | | |
| 1 | 0 | present | present |
| 2 | 0 | absent | absent |
| 3 | 0 | present | present |
| 4 | 0 | absent | absent |
| 5 | 0 | present | present |

Next, as cutting test (1), using five tool tips obtained from the same conditions, respectively, a peripheral intermittent turning test was carried out under the conditions as follows: material to be turned: S45C having four groove, cutting rate: 150 m/min, depth of cut: 2.0 mm, feed: 0.30 mm/rev and wet process. As the test results, Table 4 shows each ratio of the number of edge-broken tips before the impact times by the intermittent cutting reached 10000 times, the number of tips with exfoliation of the film (chipping) and the number of the undamaged tips which endured 10000 impact times by cutting.

Moreover, as cutting test (2), using one tool tip, an intermittent turning test was carried out under the conditions as follows: material to be turned: disks of S48C (150ϕ×30 mm), cutting rate: 50 to 180 m/min, depth of cut: 2.0 mm, feed: 0.30 mm/rev and wet process. As the damage of the cutting edge after the processing of 50 disk, the average amount of flank wear and the maximum width of crater wear at the cutting face were measured and also shown in Table 4.

TABLE 4

| Sample No. | Result of cutting test (1) (broken: film-exfoliated: undamaged) | Result of cutting test (2) Amount of flank wear (μm) | Result of cutting test (2) Width of crater (μm) |
|---|---|---|---|
| Present product | | | |
| 1 | 0:2:3 | 0.23 | 0.08 |
| 2 | 0:3:2 | 0.21 | 0.03 |
| 3 | 0:1:4 | 0.18 | 0 |
| 4 | 0:0:5 | 0.20 | 0 |
| 5 | 0:1:4 | 0.22 | 0.05 |
| 6 | 0:2:3 | 0.20 | 0.10 |
| 7 | 0:0:5 | 0.17 | 0 |
| 8 | 0:1:4 | 0.24 | 0.14 |
| Comparative product | | | |
| 1 | 3:2:0 | 0.31 | 0.35 |
| 2 | 0:4:1 | 0.30 | 0.25 |
| 3 | 1:4:0 | 0.27 | 0.18 |
| 4 | 3:0:2 | 0.32 | 0.23 |
| 5 | 3:1:1 | 0.29 | 0.39 |

Example 2

Using a tip material of SNGN120408 at ISO Standards comprising a composition of 88.0WC-2.0TaC-9.5Co-0.5Cr (wt %), the upper and lower faces and the peripheral face were ground with #270 diamond whetstone and the edge part was subjected to honing at −25°×0.10 mm with #400 diamond whetstone. Then, the tip was subjected to surface treatment respectively, under the same conditions in preparation of the present products 1, 3, 5, and 7 and the comparative products 1, 2, and 4, described in Table 1.

After subjecting to ultrasonic washing in acetone, these were coated with, from the base material side, 0.5 μm of TiN, 3.5 μm of columnar crystalline TiCN, 0.5 μm of $Al_2O_3$, 0.5 μm of TiN, with a thickness of 5.0 μm in total, using a CVD coating apparatus to obtain tool tips of surface-coated cemented carbides of the present invention 9, 10, 11 and 12 and the comparative products 6, 7 and 8, respectively.

The same analyses and observation as in Example 1 were carried out on the cutting faces of the corner part of the above-obtained tool tips (except for the X-ray diffraction). The results are shown in Table 5.

TABLE 5

| Sample No. | Kind & distribution of diffused element | Amount of diffused element (atomic %) In film | Amount of diffused element (atomic %) In base material | Content of components of base material (atomic %) Co | Content of components of base material (atomic %) W | Thickness (μ) | Crack in particles | Fine particles |
|---|---|---|---|---|---|---|---|---|
| Present product | | | | | | | | |
| 9 | containing Ni in film and base material with gradient from interface | Ni: 8–12 | 1–3 | 4–7 | 10–15 | 0 | present | present |
| 10 | containing Ni in film and base material | Ni: 9–12 | 2–4 | 2–6 | 8–12 | 0 | absent | absent |

TABLE 5-continued

| Sample No. | Kind & distribution of diffused element | Amount of diffused element (atomic %) In film | In base material | Content of components of base material (atomic %) Co | W | Thickness (μ) | Crack in particles | Fine particles |
|---|---|---|---|---|---|---|---|---|
| | with gradient from interface | | | | | | | |
| 11 | containing Ni and Cr in film and base material with gradient from interface | Ni: 5–9 Cr: 3–5 | 2–5 1–3 (0.5)* | 5–9 | 12–17 | 0 | present | present |
| 12 | containing Mn in film and base material with gradient from interface | Mn: 0.5–2 | 1–3 | 3–6 | 8–14 | 0 | absent | present |
| Comparative product | | | | | | | | |
| 6 | no diffusion except for components of film and base material | 0 | 0 | 4–8 | 6–11 | 0 | present | present |
| 7 | no diffusion except for components of film and base material | 0 | 0 | 2–5 | 3–7 | 0 | absent | absent |
| 8 | no diffusion except for components of film and base material | 0 | 0 | 7–12 | 6–11 | 0 | absent | absent |

*Content at 100 μm inside of the base material from the interface

Next, upon each tool tip, test was carried out under the conditions as follows: material to be cut: SCM440 (face shape to be processed: 50W×200L), cutting rate: 135 m/min, depth of cut: 2.0 mm, feed: 0.36 mm/edge and dry process. After the processing of 40 paths, the edge part of each tool was observed and the number of heat cracks formed at the cutting face, the exfoliated area of the film at the crater part, the average amount of flank wear and fine chipping at the edge part were evaluated. The results are shown in Table 6.

TABLE 6

| Sample No. | Number of heat crack | Exfoliated area ($\mu m^2$) | Amount of flank wear (μm) | Amount of chipping |
|---|---|---|---|---|
| Present product | | | | |
| 9 | 3 | 0.3 | 0.07 | minute |
| 10 | 2 | 0.0 | 0.05 | none |
| 11 | 3 | 0.0 | 0.06 | none |
| 12 | 3 | 0.0 | 0.05 | minute |
| Comparative product | | | | |
| 6 | 6 | 2.2 | 0.15 | large |
| 7 | 5 | 0.9 | 0.11 | little |
| 8 | 5 | 1.5 | 0.09 | slightly large |

Example 3

Commercially available solid drills (6 mmϕ) made of a cemented carbide comprising a composition of 90.0WC-9.2Co-0.8Cr (wt %) were subjected to a surface treatment, respectively, under the same conditions in preparations of the present products 5 and 7 described in Table 1 of Example 1. After subjecting to ultrasonic washing in acetone, these and surface-untreated sample (the same condition as Comparative product 1 of the Table 1) were coated with 2.0 μm of TiCN using a CVD coating apparatus to obtain surface-coated cemented carbide drills of the present invention 13 and 14 and the comparative product 9.

A peripheral edge part of each drill was analyzed in the same manner as in Example 1. Accordingly, a content of Ni of the present product 13 was found to be from 11 to 20 atomic % in the hard film, from 5 to 9 atomic % in the base material, and a content of Cr is from 3 to 10 atomic % in the hard film and from 2 to 6 atomic % in the base material (0.8 atomic % at 100 μm inside the material from the interface). Also, a content of Mn of the present product 14 is from 2 to 5 atomic % in the hard film and from 0.5 to 2 atomic % in the base material, while these diffusive elements were not detected in the comparative product 9.

Using these drills, groove processing test were carried out under the condition as follows: material to be cut: pre-hardened steel (HRC=40), cutting rate: 30 m/min, depth of cut: 10 mm, table feed: 64 mm, feed per edge: 0.02 mm/edge and wet process, and the width of flank wear of the cutting edge was measured at the time when the cutting length became 50 m. As a result, the widths were 0.05 mm and 0.06 mm in the present products 13 and 14, respectively, while it was 0.13 mm in the comparative product 9.

Example 4

Using a commercial cemented carbide material for wear resistant tool (corresponding to JIS V30) of about 10 mmϕ×

60 mm, the whole face was subjected to a rough grinding and finish grinding with #140 and #800 diamond whetstones, respectively to manufacture a punch for punching. Then, the punch was treated under the same conditions in a preparation of the present product 3 described in Table 1 of Example 1.

After subjecting to ultrasonic washing in acetone, this punch and untreated sample were coated with, from the base material side, 0.5 μm of TiN, 3.5 μm of TiC, with a total thickness of 4.0 μm, using a CVD coating apparatus to obtain surface-coated cemented carbide punches of the present invention 15 and the comparative product 10.

Using these punches, a galvanized steel having a thickness of 0.6 mm was subjected to punching and the number of shot was measured until the a defective product due to burr formation is observed. As a result, the number for the present product 15 was about 1,100,000 shots, while that for the comparative product 10 was about 430,000 shots.

In the surface-coated cemented carbide obtainable by chemical vapor deposition, by pre-coating the surface of the base material with at least one diffusive element selected from an iron group metal, chromium, molybdenum, manganese, copper and silicon, the adhesiveness is significantly improved as compared with the conventional pretreatment such as re-sintering, brush grinding, or blast treatment, due to diffusion of the elements into the hard film and the cemented carbide base material. Therefore, when the material of the present invention is used in drills, wear resistant tools, and tips for cutting tools, those tools exhibit a stable long life as the damage caused by exfoliation of the film is decreased.

What is claimed is:

1. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and the binder phase contains the at least one diffusive element, and a content of the at least one diffusive element in the cemented carbide base material is higher at a proximate portion of the interface with the hard film than inside of the base material.

2. A method for producing a surface-coated cemented carbide according to claim 1, wherein the method of coating with the at least one diffusive element is a chemical coating method selected from electroplating, electroless plating, physical vapor deposition, chemical vapor deposition, colloid application and solution application, or a mechanical coating method selected from blast processing and shot treatment using a shot material comprising an iron group metal as a main component or using a mixture of the shot material and at least one of an abrasive sweeper and an abradant.

3. A method for producing a surface-coated cemented carbide according to claim 1, wherein at least part of a surface of the cemented carbide base material before coating with the diffusive element is an as-sintered surface, a ground lap face, an electrolytic ground skin or a chemically etched face.

4. A method for producing a surface-coated cemented carbide according to claim 1, wherein the method of coating with the diffusive element is electroplating from an aqueous solution containing at least one of the diffusive element and the binder phase component, and the surface of the cemented carbide base material before coating with the diffusive element is electrolytic ground skin, the method for production thereof comprising a step of subjecting the surface to electropolishing at a current density of 0.01 to 0.2 $A/cm^2$ using, as an electrolysis solution, an aqueous solution containing at least one substance as an essential component selected from a hydroxide, a nitrite, a sulfite, a phosphite and a carbonate of a metal selected from metals of the Group 1 of the Periodic Table.

5. A method according to claim 1, wherein the content of the at least one diffusive element is at least 0.5 atomic % in the hard film and in the base material within the range of 0.5 μm from the interface between the hard film and the base material into both of the hard film and the base material.

6. A method according to claim 5, wherein the content of the at least one diffusive element is in a range of 1 to 10 atomic % in the hard film and in the base material within the range of 0.5 μm from the interface between the hard film and the base material into both of the hard film and the base material.

7. A method according to claim 1, wherein the content of the at least one diffusive element in the base material within 0.5 μm from the interface is at least 0.5 atomic % higher than a content at 100 μm inside the base material from the interface.

8. A method according to claim 1, wherein a metal layer is present at an interface between the hard film and the cemented carbide base material, comprising the diffusive element as a main component and having an average thickness of 0.5 μm or less.

9. A method according to claim 1, wherein any hard phase particles having a particle diameter of 0.2 μm or less are absent and no crack is present in the hard phase particles on a surface of the cemented carbide, at an interface between the hard film and the cemented carbide base material.

10. A method according to claim 2, wherein the method of coating with the at least one diffusive element is a chemical coating method selected from electroplating, electroless plating, colloid application and solution application, or a mechanical coating method.

11. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and wherein a content of the at least one diffusive element is at a maximum at an interface between the hard film and the cemented carbide base material and decreases toward inside the hard film and toward inside the cemented carbide base material from the interface.

12. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and wherein the binder phase component, tungsten and the at least one diffusive element are diffused and contained in the hard film located immediately on the hard phase particles at an interface between the hard film and the cemented carbide base material.

13. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and wherein the at least one diffusive element comprises iron.

14. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and wherein the at least one diffusive element comprises nickel.

15. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and wherein the at least one diffusive element comprises manganese.

16. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and wherein the at least one diffusive element comprises copper.

17. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and wherein the at least one diffusive element comprises silicon.

18. A method for producing a surface-coated cemented carbide which comprises a cemented carbide base material comprising hard phase particles containing tungsten carbide as a main component and at least one material selected from the group consisting of a carbide, a nitride and a carbonitride of a metal selected from metals of the Groups 4, 5 and 6 of the Periodic Table and a solid solution of the above-mentioned compounds and a binder phase comprising an iron group metal as a main component and a hard film formed on a surface of the base material comprising at least one layer, each of the layers comprises at least one material selected from a carbide, a nitride and an oxide of an element selected from elements of the Groups 4, 5 and 6 of the Periodic Table, aluminum and silicon and a solid solution of the above-mentioned compounds, wherein the method comprises the steps of uniformly coating at least part of the surface of the base material with a metal, an alloy or a compound comprising at least one diffusive element selected from an iron group metal, chromium, molybdenum, manganese, copper and silicon, and then, coating the surface with the hard film component; and further comprising diffusing the at least one diffusive element into the base material and into the hard film.

* * * * *